US007108397B2

(12) United States Patent
Wu

(10) Patent No.: US 7,108,397 B2
(45) Date of Patent: Sep. 19, 2006

(54) STRING LAMPS DEVICE

(76) Inventor: Jeng-shyong Wu, No. 14, Alley 1. Lane 326, Shin-Pin Road, Hsinchu (TW)

( * ) Notice: Subject to any disclaimer, the term of this patent is extended or adjusted under 35 U.S.C. 154(b) by 204 days.

(21) Appl. No.: 10/789,080

(22) Filed: Feb. 26, 2004

(65) Prior Publication Data

US 2005/0190555 A1 Sep. 1, 2005

(51) Int. Cl.
*F21V 23/00* (2006.01)

(52) U.S. Cl. ..... 362/251; 362/249; 362/234

(58) Field of Classification Search ..... 362/277, 362/251, 252, 249, 124, 565, 800, 806, 644, 362/653, 654, 234, 236; 315/185 S, 200 R
See application file for complete search history.

(56) References Cited

U.S. PATENT DOCUMENTS 2,461,962 A * 2/1949 Carlson ..... 362/249
5,379,202 A * 1/1995 Daun ..... 362/251
5,453,664 A * 9/1995 Harris ..... 315/185 S
5,951,146 A * 9/1999 Lin ..... 362/251
6,402,336 B1 * 6/2002 Reese ..... 362/251
6,505,954 B1 * 1/2003 Chen ..... 362/234
6,580,228 B1 * 6/2003 Chen et al. ..... 362/240
6,650,065 B1 * 11/2003 Shieh ..... 315/185 S
6,971,765 B1 * 12/2005 Wu ..... 362/251

* cited by examiner

*Primary Examiner*—Ali Alavi
*Assistant Examiner*—Bao Q. Truong
(74) *Attorney, Agent, or Firm*—McGlew & Tuttle, PC

(57) ABSTRACT

Disclosed is a string lamps device that is composed of a plurality of illuminate devices through series, parallel, and series and parallel connection. At least one of the illuminant devices is function type illuminant device, in which a default control device is provided inside the lamp holder. The control device can bring radial transition effect separately, and exhibit special radial transition effect when plugged into a pre-determined modeling frame together with other illuminant devices.

31 Claims, 9 Drawing Sheets

STRING LAMPS DEVICE

BACKGROUND OF THE INVENTION

1. Field of the Invention

The present invention relates to a string lamps device, and more particularly to a string lamps connected in series with a plurality of illuminant devices, in which at least one of the illuminant devices is function type illuminant device. As the lamps string with function type illuminant device is entirely plugged into the pre-determined modeling frame, radial transformation effect that matches up the modeling frame can be shown.

2. Description of the Prior Art

Generally, in a conventional illuminant device, illuminant components such as light bulbs or LED are connected in series to the wire to conduct power source for the purpose of illumination or decoration. In the so called decorative lamp device, as shown in FIG. 1, a plurality of illuminant devices 11, 12, 13, 14 . . . are connected as lamps string 10 through series, parallel, and series and parallel connection to display radial transition effect after power source is conducted. This is used in special occasions such as holidays, celebration, and commercial advertisement to demonstrate the atmosphere of joyous events.

In a conventional lamps string, the flash and extinguishment of the lamps string is controlled by a controller. Moreover, the illuminant devices 11, 12, 13, 14 . . . in the lamps string has the same illuminant function. The controller may be impractical because it is external device and occupy large space. Moreover, the lamps string connected through a plurality of illuminant components with the same function is limited to the effect of simultaneous flash and extinguishment.

Accordingly, the present invention has been invented to solve the above-mentioned problems occurred in the prior art.

SUMMARY OF THE INVENTION

Accordingly, an object of the present invention is to provide a string lamps device, which is connected in series by a plurality of illuminant devices and one of the illuminant devices is function type illuminant device.

In the string lamps device according to the present invention, one of the illuminant devices is function type illuminant device that can prevent the inconvenience from adding an extra external controller. This serves as another purpose of this invention.

In the string lamps device of the present invention, a number of function type illuminant devices and conventional illuminate device can be used by turns to enhance the lamp's decorative effect, which is served as another purpose of this invention.

The above purposes and structure of the present invention will be more apparent from the following detailed description taken in conjunction with the accompanying drawings:

BRIEF DESCRIPTION OF THE DRAWINGS

For fuller understanding of the nature and objects of the invention, reference should be made to the following detailed description taken in conjunction with the accompanying drawings in which.

DETAILED DESCRIPTION OF THE PREFERRED EMBODIMENT

Figure 1:
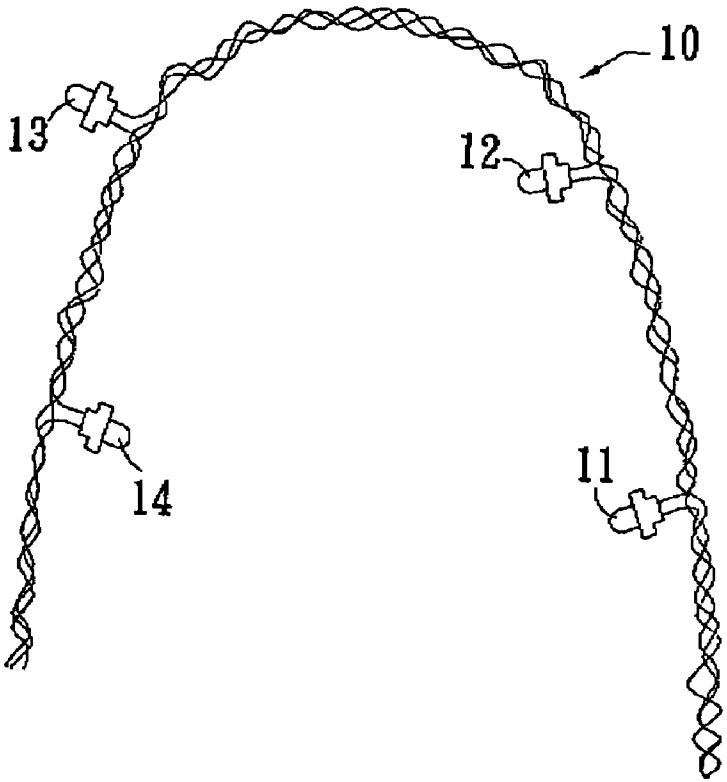
FIG. 1 PRIOR ART
FIG. 1 is a conventional lamp string.
Figure 2:
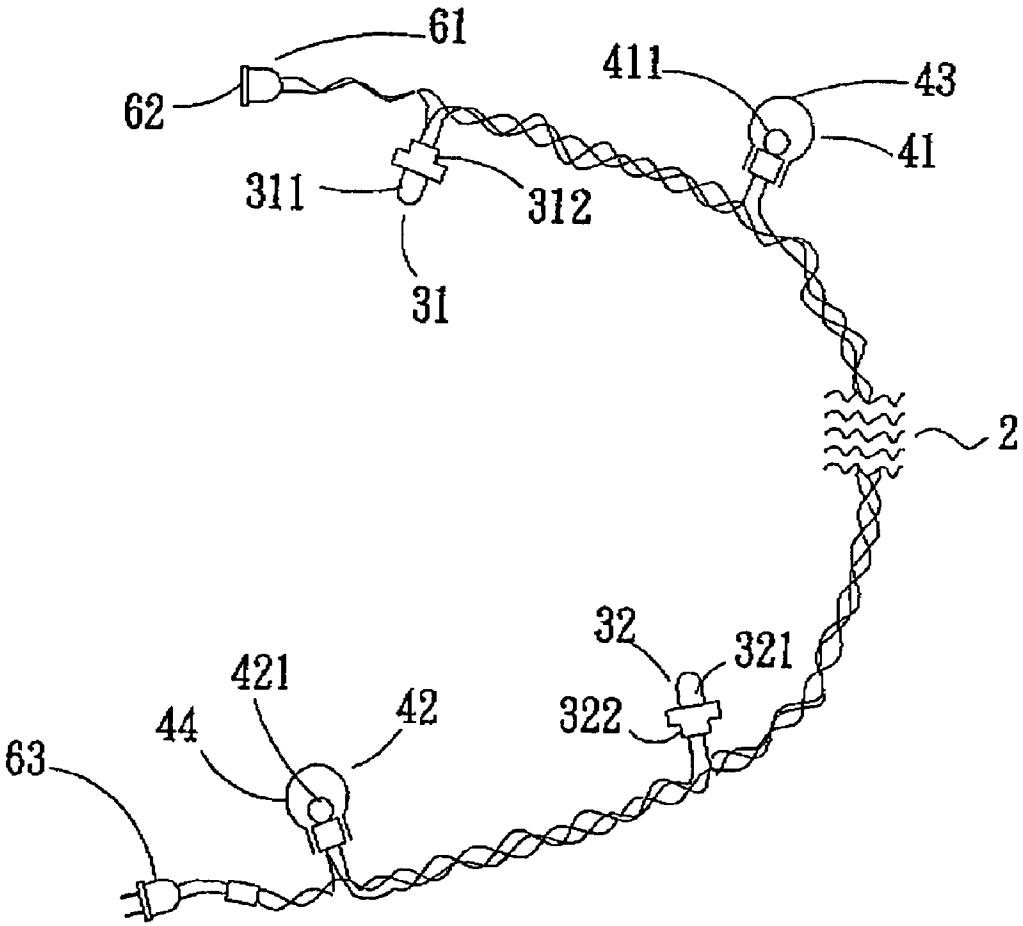
FIG. 2 is a lamp string according to the present invention.
Figure 10:
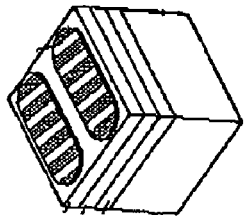
FIG. 10 is a typical LED made from a wafer.
Figure 3A:
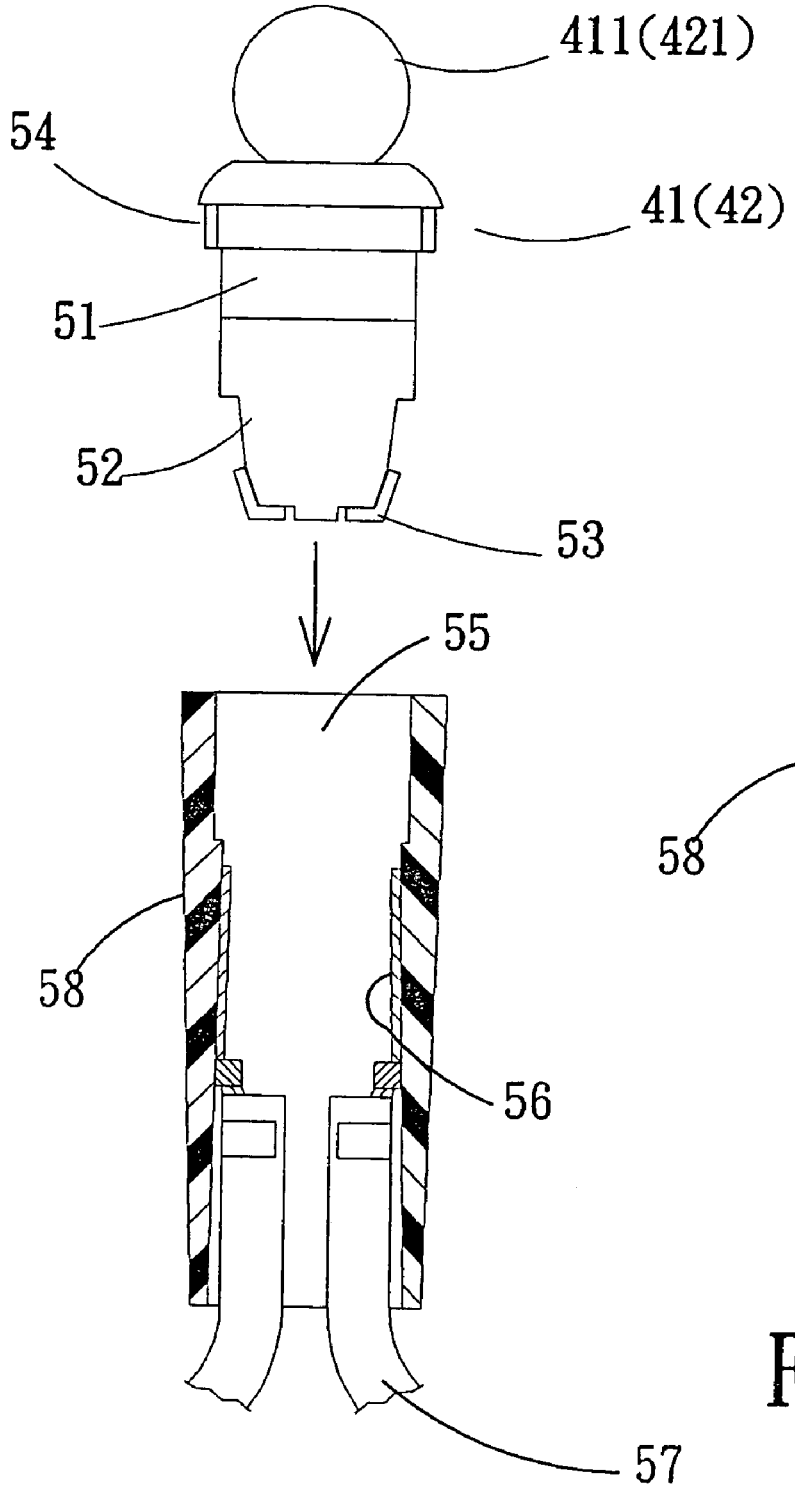
FIG. 3 is a three-dimensional disassembled view of a function type illuminant device according to the present invention.
Figure 3B:
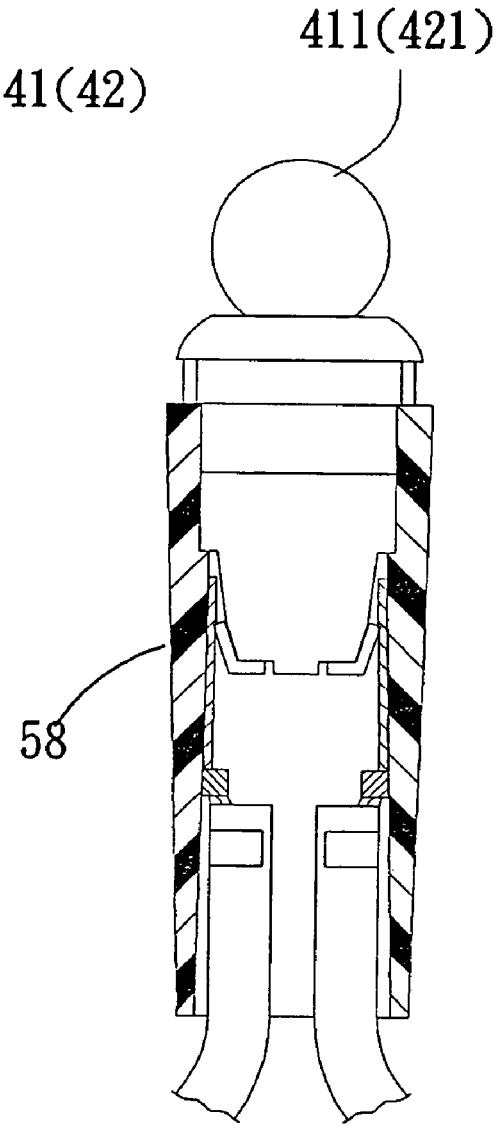

In the string lamps device of the present invention, as shown in FIGS. 2 and 3, the lamps string device 2 includes: a plurality of illuminant device 31 and 32 using LED lamps, in which LED lamps 311 and 321 are located in its upper end, lamp holder 312 and 322 are located in its bottom, and wires inside the lamp holder 312 and 322 are connected to the upper end LED lamps 311 and 321. Another end of the wires in each illuminant device is connected as a lamps string through series, parallel, and series and parallel connection.

Two function type illuminant devices 41 and 42, which are connected in series to the illuminant device 31 and 32. LED bulb 311 and 321 are provided in its upper end, in which a plurality of LED bulbs are connected through series, parallel, or series and parallel connection. Lamp base 54 is provided in its bottom, which is connected together to a default control device 51;

Two lamp shields 43 and 44, which are covered in the external part of the function type illuminant device 41 and 42, and its internal part can be smeared with reflecting powder and diverse colors to enhance decorative lamps' multi-transition effect;

A rectification controller 52, which is provided in the bottom of the above-mentioned function type illuminant device and connected to the default control device 51 as a whole. A wire 53 in its bottom is extended downward and then wound to an external wall to be fixed;

Two lamp holders 58, in which a tube-shape adaptive space 55 for adapting the lamp base of the function type illuminant device is formed. In the adaptive space, there is provided a bent-shape conductance spring for tightly covering the bottom of the lamp base of the function type illuminant device. After the function type illuminant device is plugged, a loop is formed with its external wire 53. The bottom of the conductance spring 56 is connected to the insulated wire 57, and through the insulated wire 57, connected to the insulated wire of other illuminant device through series, parallel, or series and parallel connection;

An end plug 61: its one end is plug end 62 (either as male end or female end) for connecting with other ends, and another end is connected with one end of the insulated wire in the said lamps string;

A power adapter 63, which is connected to the insulated wire in another end of the above-mentioned lamps string, and another end can conduct power source.

Through the combination of the components described above, a lamp string device having a plurality of illuminant device, in which parts of illuminant device is function type illuminant device, is formed so that various radial transition decorative effect can be generated. When used in coordination with other illuminant devices that merely have basic illuminant modes such as flash and extinguishment, the entire lamps string can show unique decorative lamp effect.

Figure 4A:
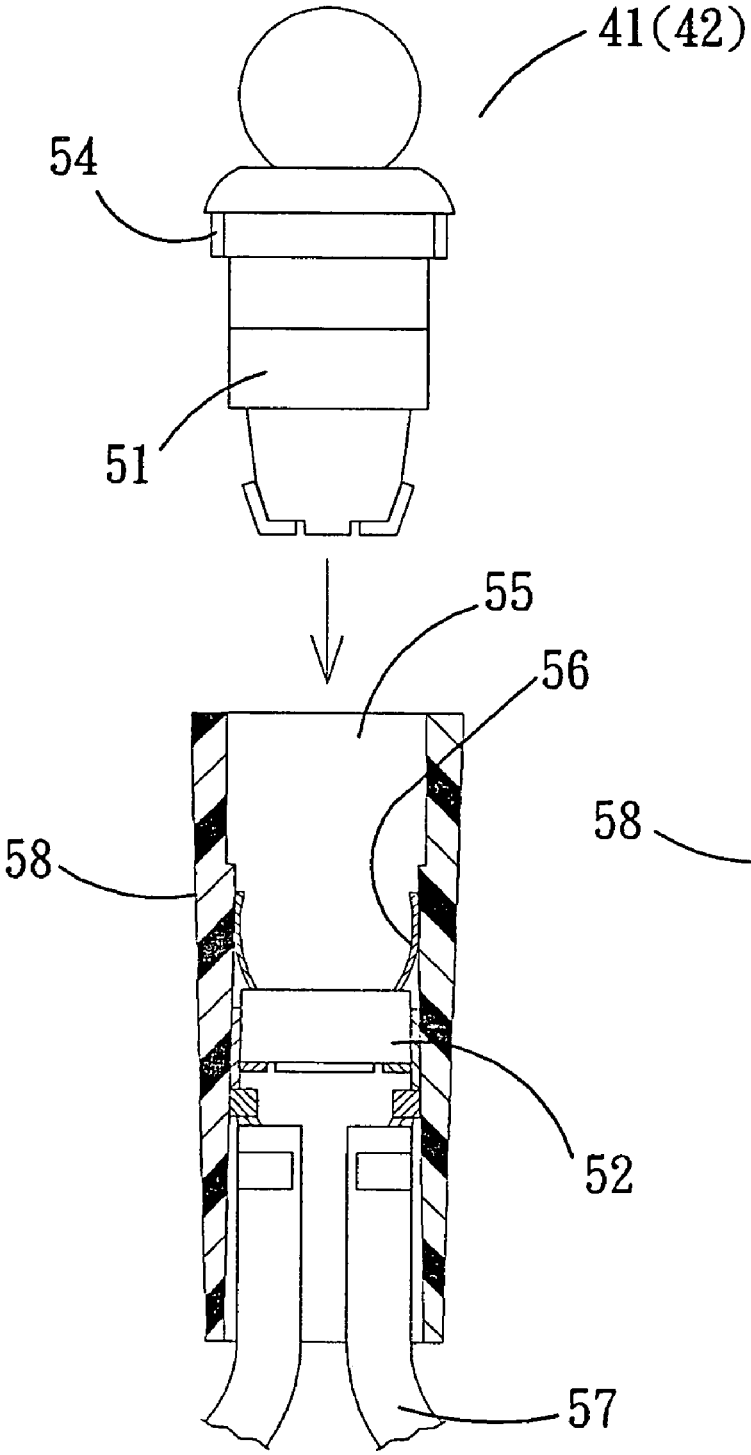
FIG. 4 is a three-dimensional disassembled view of another function type illuminant device according to the present invention.
Figure 4B:
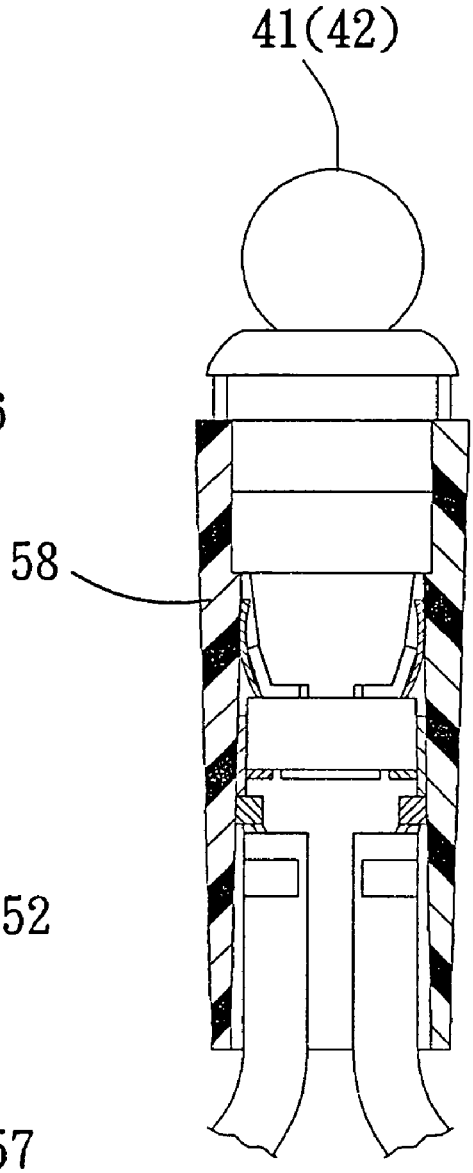

As shown in FIG. 4, the difference between another embodiment of the function type illuminant device in the present invention and the one in FIG. 3 is that the bottom of the function type illuminant device 41(42) is directly connected to the control device 51, so that the bottom wire 53 is extended and then directly wound to the external wall of the control device 51 to be fixed. A rectification controller 52 is provided in the adaptive space of lamp holder 58, and connected to the conductance spring in the lamp holder beforehand. An upper part of the conductance spring is bulged out from the rectification controller 52, so that when the function type illuminant device 41(42) and control device 51 are completely plugged into the adaptive space of the lamp holder 58, the wire 53 in the external wall of the control device 51 can be connected to the rectification controller 52 to form a loop.

Figure 5:
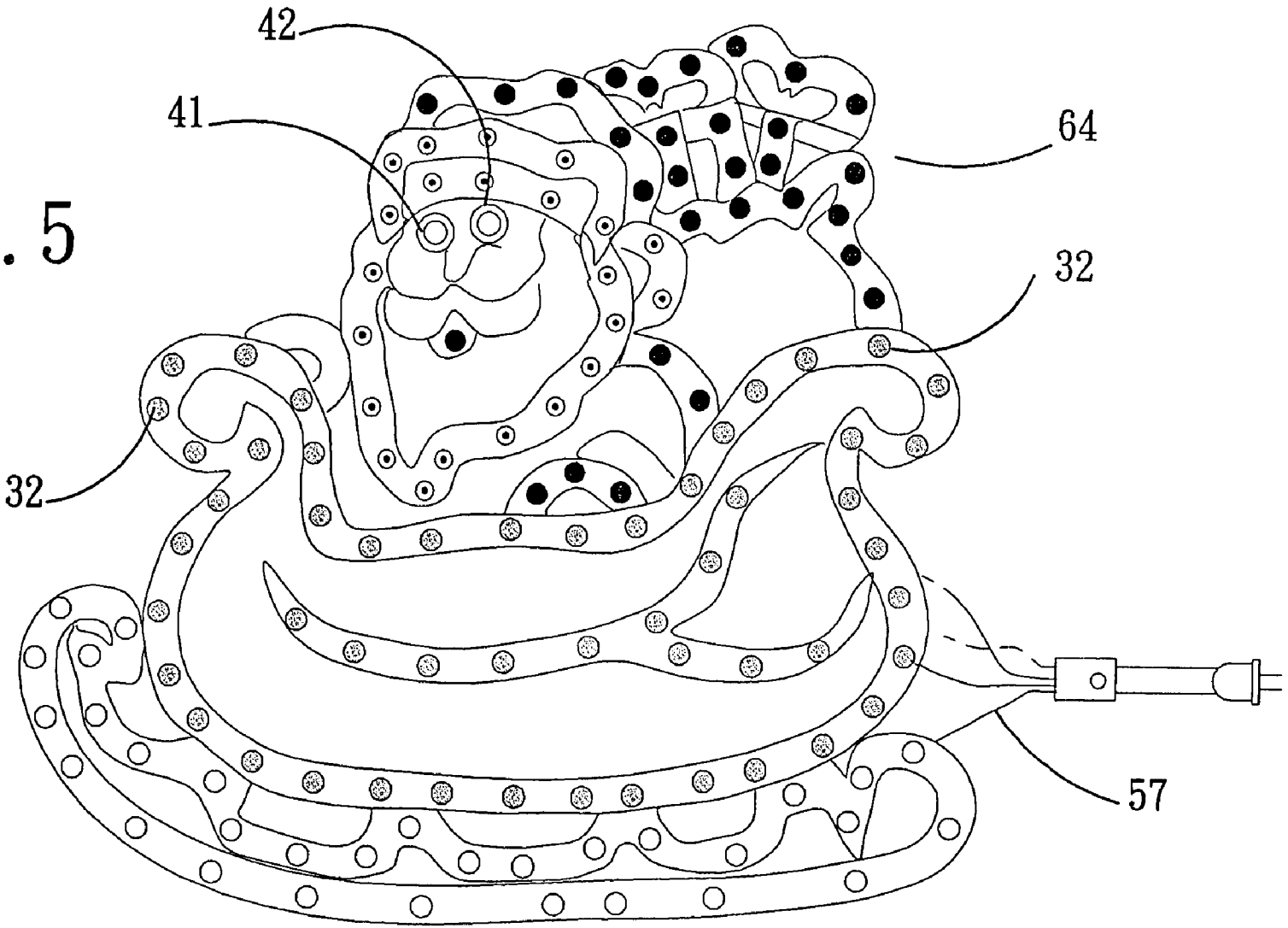
FIG. 5 is an embodiment of the present invention.

As the lamp string device of the present invention is implemented, as shown in FIG. 5, it can be used in coordination with pre-molded modeling frame 64 or background, such as the human body, Santa Claus, or other animals. A plurality of holes on the sockets are formed along the surface edge of the modeling frame 64 or in the location that will load the lamps string for plugging with illuminant devices or function type illuminant devices. After using the insulated wire 57 to connect the illuminant devices or function type illuminant devices through series, parallel, or series and parallel connection, and the power adapter 63 conducts the power source, a specific molding lamp decoration effect will be shown. Since the illuminant mode of the function type illuminant device can be controlled by the control device 51 alone, the illuminant effect different from other illuminant devices can be shown. When the illuminant device is used on other eye-catching parts, such as eyes or forehead, the effect for the modeling frame 64 will be more apparent.

Figure 6:
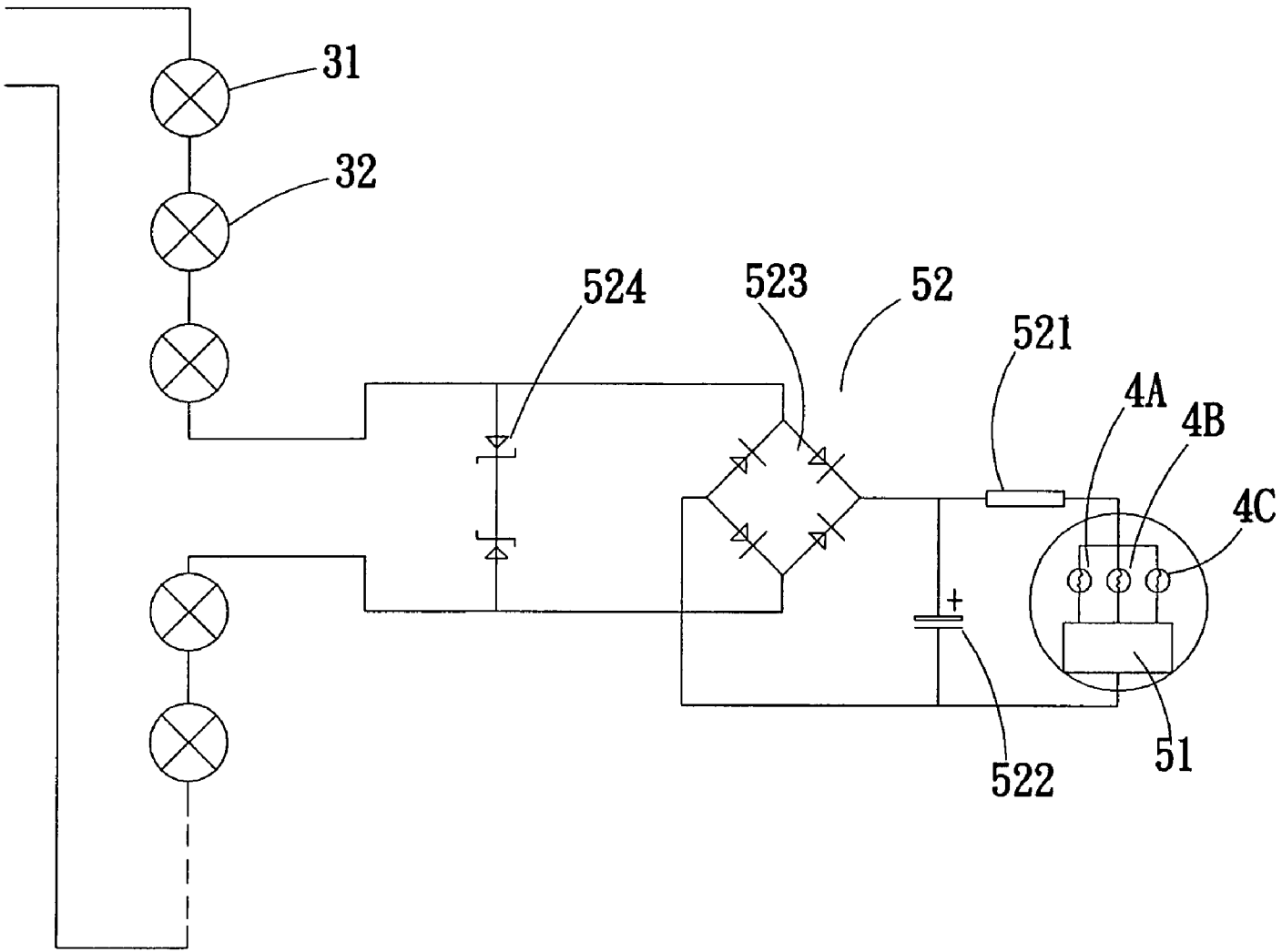
FIG. 6 is an enlarged view of the second embodiment according to the present invention.

The lamp string device of the present invention has various embodiments as described below:

As shown in FIG. 6, the string lamps device is connected in series by a plurality of illuminant devices 31 and 32, and then connected to the function type illuminant device 41(42) through the rectification controller 52 that comprises electric elements such as resistance 521, capacitance 522, bridge rectifier 523, and zener diode 524 for the purpose of voltage stabilization, transformation, and rectification. In the function type illuminant device 41(42), three tungsten bulbs 4A, 4B, and 4C are formed through parallel connection and connected to the control device 51 in the bottom. When the tungsten bulbs are used, they can be connected as a whole for use; or without the function type illuminant device 41(42), other illuminant device can be connected in series for use separately; or without the rectification controller 52, other series illuminant devices are directly connected to the function type illuminant device 41(42) for use. Accordingly, the string lamps set of the present invention has a lot of feasibility for use in various locations.

Figure 7:
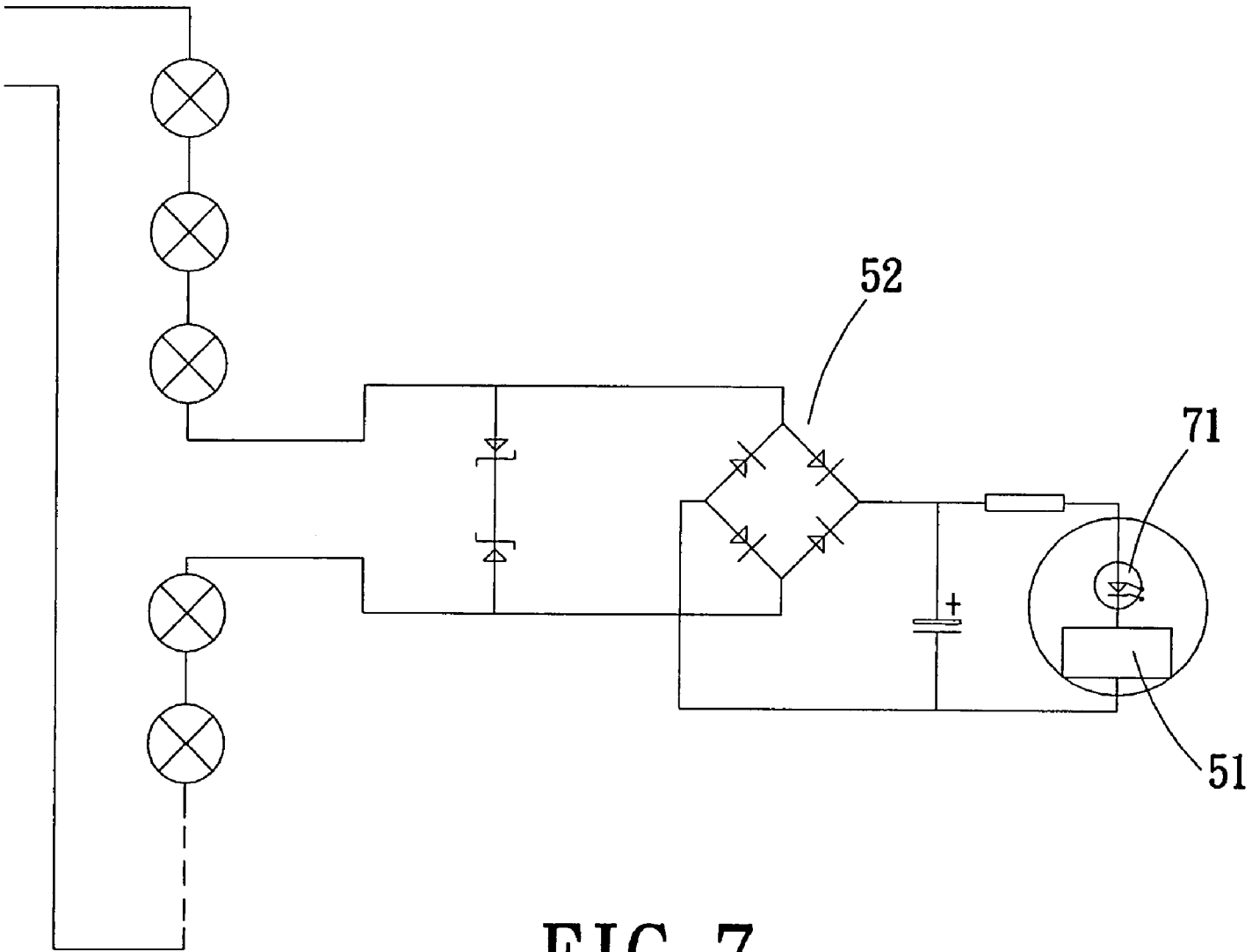
FIG. 7 is an enlarged view of the third embodiment according to the present invention.

As shown in FIG. 7, another variation of the string lamps set in FIG. 5, the illuminant part of the function type illuminant device 41(42) does not use the parallel tungsten bulbs 4A, 4B, and 4C, but LED lamps 71 that packaged by varied-color LED chips as a whole, as the illuminant. The LED lamps 71 is then connected to the control device 51 in the bottom, and connected to other illuminant components along with the rectification controller 52 that comprises electric elements such as resistance 521, capacitance 522, bridge rectifier 523, and zener diode 524, so that a novel and unique string lamps set is formed.

Figure 8:
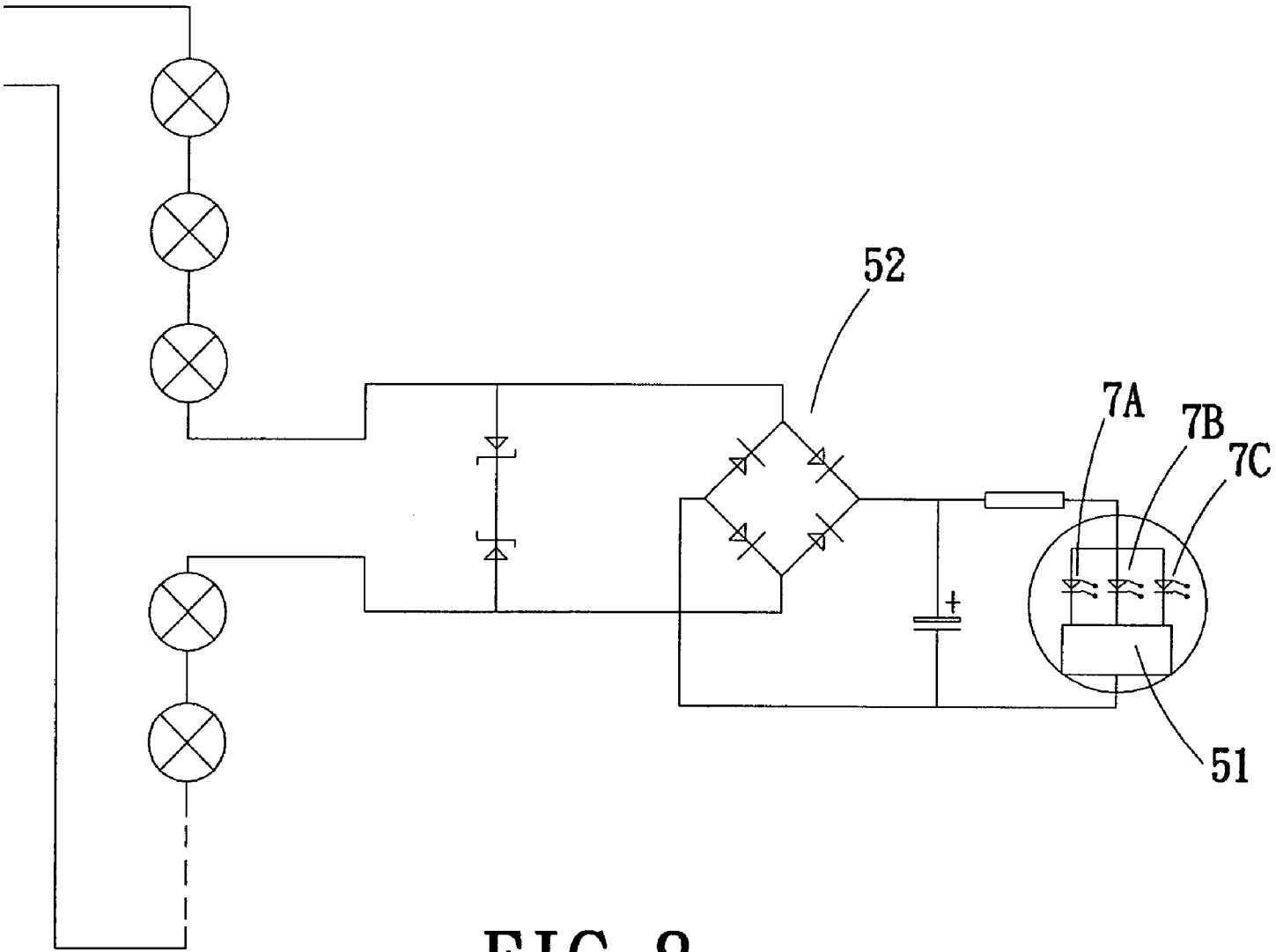
FIG. 8 is the fourth embodiment of the present invention.

As shown in FIG. 8, another variation of the string lamps set in FIG. 5, the illuminant part of the function type illuminant device 41(42) does not use the parallel tungsten bulbs 4A, 4B, and 4C, but varied-color LED bulbs (such as red LED, green LED, and blue LED), as the illuminant. The LED bulbs are connected to the control device 51 in the bottom, and then connected to other illuminant components along with the rectification controller 52 that comprises electric elements such as resistance 521, capacitance 522, bridge rectifier 523, and zener diode 524, so that a novel and unique string lamps set is formed.

Figure 9:
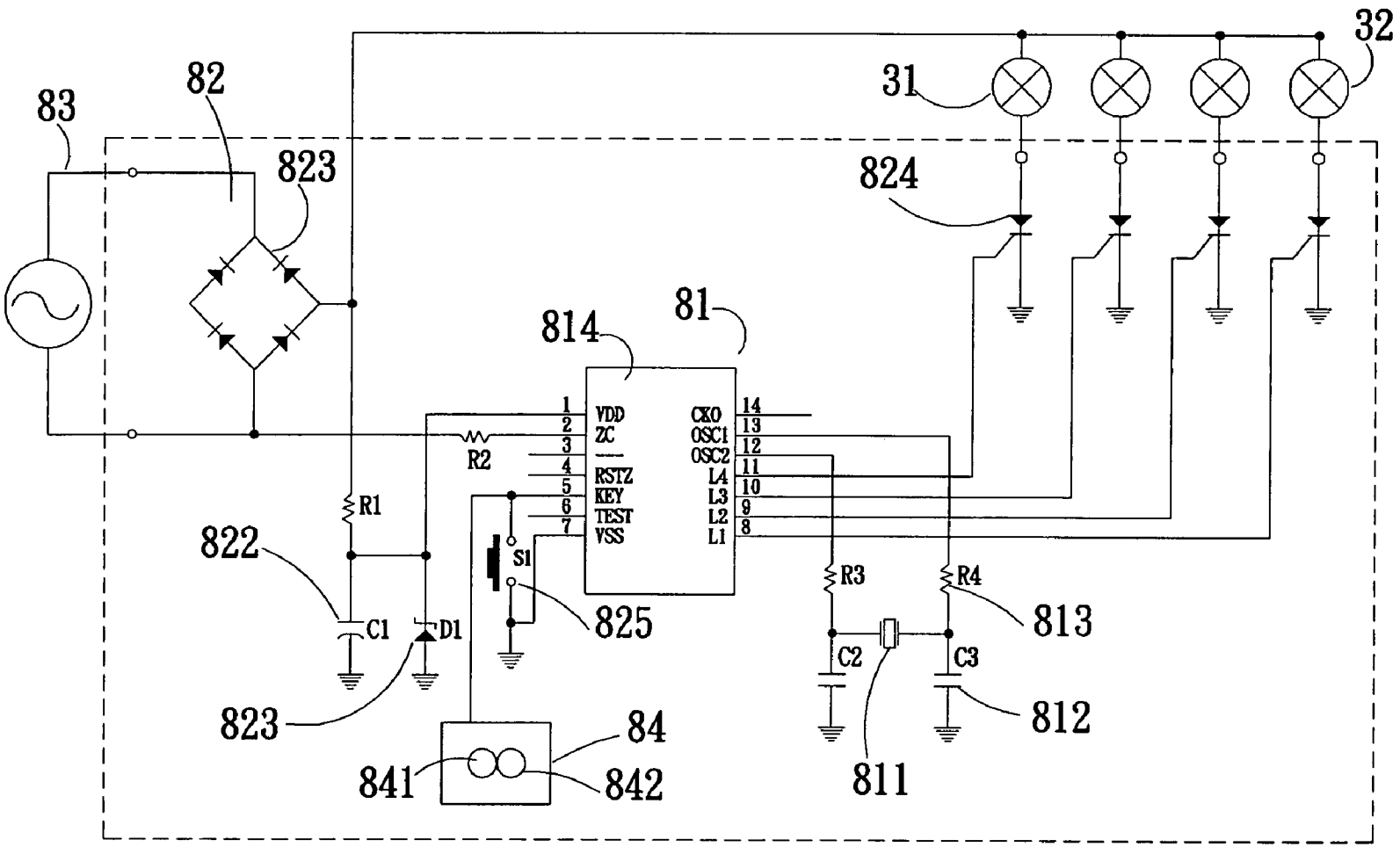
FIG. 9 is a schematic circuit view of the control device.

Also, as shown in FIG. 9, the control device provided inside the function type illuminant device described above includes:

An IC chip 81, in which an oscillator 811, capacitance 812, resistance 813, and IC 814 are connected to form oscillation circuit, generates basic reference frequency needed in the internal operation of the IC 814. Each action in the internal part of IC 814 can follow this frequency as criterion to achieve synchronization. The IC chip also has the function of receiving the power source and signal, generating default function, and sending control signals;

An IC chip assisted parts assembly 82, comprising a rectifier 821, capacitance 822, constant voltage diode 823, SCR 824, and switch 825, having the function of adjusting, changing, and controlling the magnitude and quality to shift, adjust, stabilize, and start the string lamps set;

A power connector 83, which is connected to the IC chips 81 and assisted parts assembly 82;

A signal receiver mechanism 84, which is used for connection with the power source and IC chips 81 and assisted parts assembly 82, using infrared rays or radio frequency and its signal generator 841 and signal receiver 72 are combined as a whole. Based on the practical consideration, the IC chip 81 has the function of pre-determined on/off (automatic on/off) or re-starting (reset);

The integral structure is then connected by the wire.

Based on the description above, many lamp sets can be connected in series for IC chips and its assisted parts assembly to drive the multi-string lamps set, so that the illuminant device can generate brightness and darkness or flash and extinguishment. Then, any of the IC chip sends signal to the IC chip in each lamp set to co-start or reset each string lamps set, controlling the same default electric equipment function to form simultaneous operation of the multi-string lamps set.

To sum up, the string lamp device of the present invention enables the decorative lamps to display a variety of radial transition effect, which is not seen in the conventional decorative lamps. Also, the present invention has not yet been made public, which is consistent with relevant Patent Law.

Although the above-mentioned embodiments of the present invention have been described for illustrative purposes, those skilled in the art will appreciate that various modifications, additions and substitutions are possible, without departing from the scope and spirit of the invention as disclosed in the accompanying claims.

What is claimed is:

1. A string lamps device, comprising:

a plurality of basic illuminant devices, each said basic illuminant devices including a basic illuminant component and a basic lamp holder or a basic lamp base;

at least one function type illuminant device, said function-type illuminant device including at least one function type illuminant component, a default control device, and a function type lamp holder or a function type lamp base, wherein said control device and said function type illuminant component are connected through series or parallel connection provided inside said function type lamp holder or said function type lamp base;

a power plug connector, said power plug connector including a power adapter or an end plug; and an insulated wire connecting said basic lamp holder or said basic lamp base of said basic illuminant devices, and said function type lamp holder or said function type lamp base of said function types illuminant device, with said power plug connector through series or series and parallel connection to form the string lamps device, said power source powering said function type illuminant device in the string lamps device to selectively illuminate said function type illuminant components to display a preset radial transition mode and a pre-determined decorative effect distinct from a basic illuminant mode of said basic illuminant devices.

2. The string lamps device as claimed in claim 1, wherein said basic illuminant device uses LED or tungsten lamps as said illuminant component.

3. The string lamps device as claimed in claim 1, wherein said function type illuminant device uses LED or tungsten lamps as said function type illuminant component.

4. The string lamps device as claimed in claim 1, wherein said function type illuminant component used in said function type illuminant device can be made from a number of LED or tungsten lamps in the same color or in different colors.

5. The string lamps device as claimed in claim 1, wherein said function type illuminant component used in said function type illuminant device is LED bulbs made from a number of LED wafers in the same color or in different colors.

6. The string lamps device as claimed in claim 1, wherein an external part of said function type illuminant device has a pre-molded lamp shield.

7. The string lamps device as claimed in claim 6, wherein said pre-molded lamp shield is coated in varied colors.

8. The string lamps device as claimed in claim 1, wherein the string lamps device are strung as pre-determined model, pattern, or words.

9. The string lamps device as claimed in claim 1, wherein the default control device is composed of a rectification controller and a function controller.

10. The string lamps device as claimed in claim 9, wherein said rectification controller is composed of various electric components, including resistances, capacitances, bridge rectifiers, and Zener diodes, provided with the function of voltage stabilization, rectification, and transformation.

11. The string lamps device as claimed in claim 9, wherein said function controller is composed of IC and other electric components, having the function of switching, timing, crescendo, diminuendo, sequencing, or non-sequencing.

12. The string lamps device as claimed in claim 9, wherein said function controller has a simultaneous control electric component that can generate the pre-determined frequency to achieve the simultaneous operation function.

13. The string lamps device as claimed in claim 9, wherein said function controller has pre-determined infrared rays or radio frequency to receive electric elements and pre-determined launching signal for remote control.

14. The string lamps device as claimed in claim 9, wherein said rectification controller and function controller can be set inside the lamp base or lamp holder at the same time, or provided inside the lamp base or lamp holder separately based on the pre-determined condition for interchangeable use.

15. The string lamps device as claimed in claim 9, wherein the spare wire and lamp holder or the wires of illuminant device are connected to each other after the rectification controller and function controller are packaged.

16. The string lamps device as claimed in claim 1, wherein said string lamps set is fixed in a frame or background board with a pre-determined model, a pattern, or words, and said function type illuminant device is set in specific or important parts.

17. A string lamps device, comprising:

a plurality of illuminant devices, each of said illuminant devices including an illuminant component and a lamp holder or a lamp base;

at least one function type illuminant device, said function type illuminant device including at least one function type illuminant component, a default control device, and a function type lamp holder or a function type lamp base, wherein said control device and said function type illuminant component are connected through series or parallel connection provided inside said function type lamp holder or said function type lamp base;

a power plug connector, said power plug connector including a power adapter or an end plug;

an insulated wire connecting said lamp holder or said lamp base of said illuminant devices, and said function typelmap holder or said function type lamp base of said function types illuminant device, with said power plug connector through series or series and parallel connection to form the string lamp device; and a frame or a background board with a pre-determined model, a pattern, or words, said frame or said background board providing a fixed position for the string lamp device, wherein said function type illuminant device is provided on a specific or an important part of said frame or said background, said power source powering said illuminant devices and said function type illuminant type device in the string device to selectively illuminate said function type illuminant component distinctively in displaying a preset radial transition mode and a pre-determined decorative effect distinct from a basic mode.

18. The string lamps device as claimed in claim 17, wherein said illuminant device uses LED or tungsten lamps as said illuminant component.

19. The string lamps device as claimed in claim 17, wherein said function type illuminant device uses LED or tungsten lamps as said function type illuminant component.

20. The string lamps device as claimed in claim 17, wherein said function type illuminant component used in said function type illuminant device can be made from a number of LED or tungsten lamps in the same color or in different colors.

21. The string lamps device as claimed in claim 17, wherein said function type illuminant component used in said function type illuminant device is LED bulbs made from a number of LED wafers in the same color or in different colors.

22. The string lamp device as claimed in claim 17, wherein an external part of said function type illuminant device has a pre-molded lamp shield.

23. The string lamps device as claimed in claim 22, wherein said pre-molded lamp shield is coated in varied colors.

24. The string lamps device as claimed in claim 17, wherein the string lamp device are strung as pre-determined model, pattern, or words.

25. The string lamps device as claimed in claim 17, wherein the default control device is composed of a rectification controller and a function controller.

26. The sting lamps device as claimed in claim 25, wherein said rectification controller is composed of various electric components, including resistances, capacitances, bridge rectifiers, and Zener diodes, provided with the function of voltage stabilization, rectification, and transformation.

27. The string lamps device as claimed in claim 25, wherein said function controller is composed of IC and other electric components, having the function of switching, timing, crescendo, diminuendo, sequencing, or non-sequencing.

28. The string lamps device as claimed in claim 25, wherein said function controller has a simultaneous control electric component that can generate the pre-determined frequency to achieve the simultaneous operation function.

29. The string lamps device as claimed in claim 25, wherein said function controller has pre-determined infrared rays or radio frequency to receive electric elements and pre-determined launching signal for remote control.

30. The string lamps device as claimed in claim 25, wherein said rectification controller and function controller can be set inside the lamp base or lamp holder at the same time, or provided inside the lamp base or lamp holder separately based on the pre-determined condition for interchangeable use.

31. The string lamps device as claimed in claim 25, wherein the spare wire and lamp holder or the wires of illuminant device are connected to each other after the rectification controller and function controller are packaged.

* * * * *